US009429019B2

(12) United States Patent
Stuehlinger et al.

(10) Patent No.: US 9,429,019 B2
(45) Date of Patent: Aug. 30, 2016

(54) HIGH PRESSURE DEVICE FOR FLUID MEDIA

(71) Applicant: BHDT GmbH, Kapfenberg (AT)

(72) Inventors: Rene Stuehlinger, Oberaich (AT); Franz Trieb, Kapfenberg (AT)

(73) Assignee: BHDT GmbH, Kapfenberg (AT)

( * ) Notice: Subject to any disclaimer, the term of this patent is extended or adjusted under 35 U.S.C. 154(b) by 463 days.

(21) Appl. No.: 13/784,278

(22) Filed: Mar. 4, 2013

(65) Prior Publication Data

US 2013/0228068 A1 Sep. 5, 2013

(30) Foreign Application Priority Data

Mar. 5, 2012 (AT) ..... A 280/2012

(51) Int. Cl.

| | |
|---|---|
| ***F01B 31/00*** | (2006.01) |
| ***F04B 37/12*** | (2006.01) |
| ***F04B 53/02*** | (2006.01) |
| ***F04B 53/16*** | (2006.01) |

(52) U.S. Cl.

CPC ..... *F01B 31/00* (2013.01); *F04B 37/12* (2013.01); *F04B 53/02* (2013.01); *F04B 53/166* (2013.01); *F04B 53/168* (2013.01)

(58) Field of Classification Search

CPC ..... F04B 53/00; F04B 53/02; F04B 53/16; F04B 53/168; F04B 53/166; F04B 37/12; F04B 39/126; F01B 31/00

USPC ..... 92/59, 140, 169.1, 171.1; 417/415, 571; 267/136, 141.4, 141.5

See application file for complete search history.

(56) References Cited

U.S. PATENT DOCUMENTS 3,129,948 A * 4/1964 Kendall ..... F16J 15/185 277/514
3,396,711 A * 8/1968 Fangman et al. ..... 123/193.3

(Continued)

FOREIGN PATENT DOCUMENTS

| | | |
|---|---|---|
| EP | 0 505 352 | 9/1992 |
| EP | 0 551 590 | 7/1993 |

(Continued)

OTHER PUBLICATIONS

Schnorr, A. "Disk Spring Handbook," Adolf Schnorr GmbH + Co. 2003.*

(Continued)

*Primary Examiner* — Thomas E Lazo
*Assistant Examiner* — Richard Drake
(74) *Attorney, Agent, or Firm* — Greenblum & Bernstein, P.L.C.

(57) ABSTRACT

Cylinder unit of a high pressure pump for a fluid. Cylinder unit includes a cylinder formed by at least two concentric tubular components coupled by a shrink connection. A flange part with sealing system is detachably connected on one side of the cylinder, and sealing system has a movable plunger and a bearing bushing. A valve body is connected on other side of the cylinder. Bearing bushing and radially outermost component are arranged to bear against flange part to form an intermediate gap, a spring device has a distal portion supported on outermost component of the cylinder and a proximal portion on an outside of bearing bushing, and a valve body against which an other side of the cylinder bears are included. The tubular components have a metallic connection in a region of a surface bearing between the valve body and the cylinder.

19 Claims, 1 Drawing Sheet

(56) References Cited

U.S. PATENT DOCUMENTS

| | | | | |
|---|---|---|---|---|
| 4,717,317 | A * | 1/1988 | Hofer | F04B 53/166 417/392 |
| 4,842,438 | A * | 6/1989 | Bortolin | G02B 6/4407 156/158 |
| 4,936,197 | A * | 6/1990 | Brent | 92/168 |
| 6,113,304 | A * | 9/2000 | Tremoulet, Jr. | F04B 53/147 403/26 |
| 6,231,323 | B1 * | 5/2001 | Jezek | 417/567 |
| 6,886,832 | B2 * | 5/2005 | Forrest | 277/375 |
| 2005/0249615 | A1 * | 11/2005 | Jezek | 417/415 |
| 2006/0123616 | A1 * | 6/2006 | Aday | F04B 15/02 29/446 |
| 2011/0154983 | A1 * | 6/2011 | Bischofberger et al. | 92/169.1 |

FOREIGN PATENT DOCUMENTS

| | | |
|---|---|---|
| EP | 1 845 290 | 10/2007 |
| WO | 99/14500 | 3/1999 |

OTHER PUBLICATIONS

Palmer, Andrew C. King, Roger A.. (2008). Subsea Pipeline Engineering (2nd Edition)—4.4.9 Nonbonded, Tight-Fit Pipe (TFP). PennWell. Online version available at: http://app.knovel.com/hotlink/pdf/id:kt0087LK31/subsea-pipeline-engineering/nonbonded-tight-fit-pipe.*

Austrian Office Action conducted in counterpart Austria Appln. No. A 280/2012 (Aug. 23, 2012) (w/ English language translation).

* cited by examiner

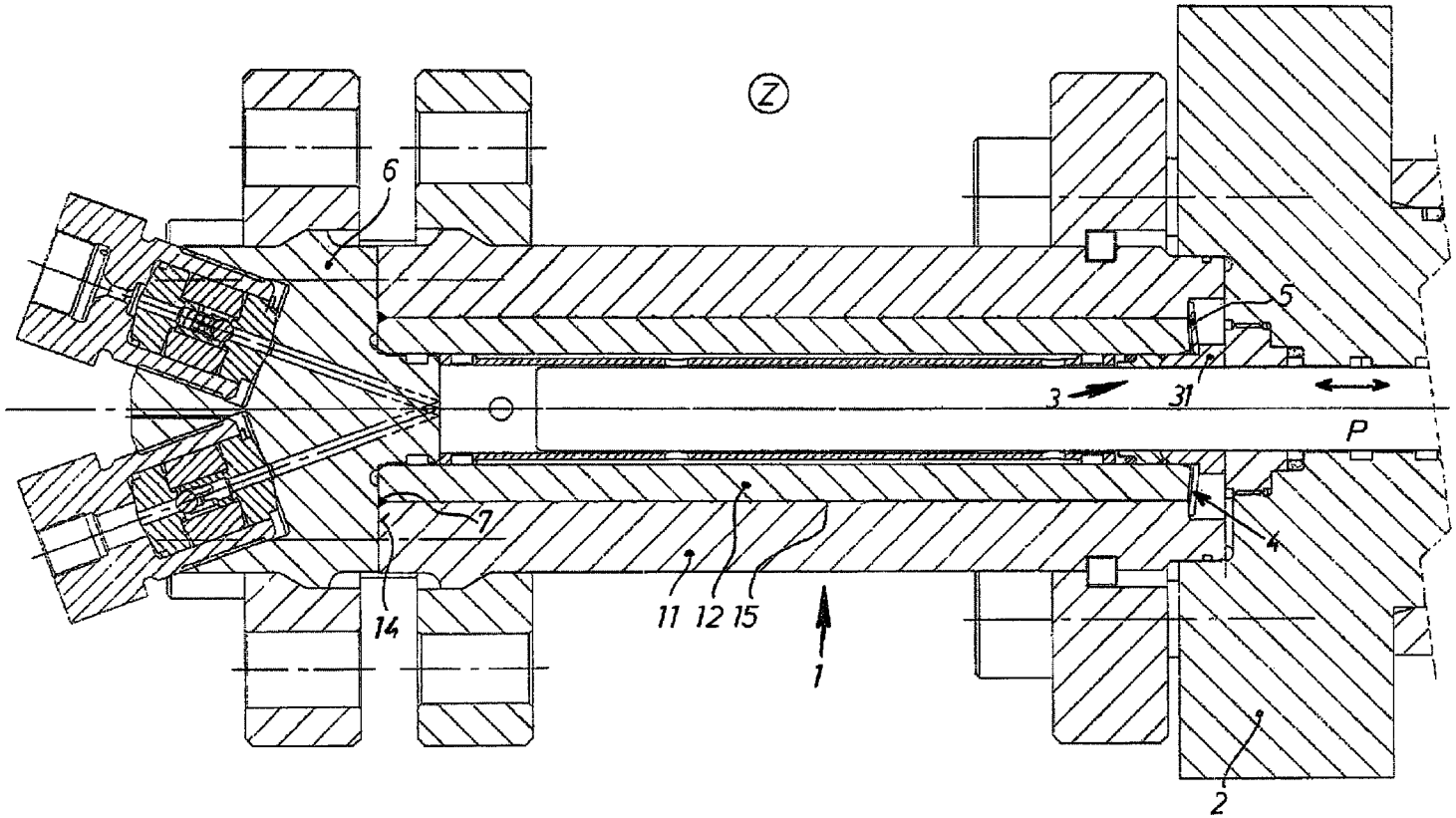
P
5
4
2
31
3
1
11 12 15
7
6
14

HIGH PRESSURE DEVICE FOR FLUID MEDIA

CROSS-REFERENCE TO RELATED APPLICATIONS

The present application claims priority under 35 U.S.C. §119 of Austrian Patent Application No. A 280/2012 filed Mar. 5, 2012, the disclosure of which is expressly incorporated by reference herein in its entirety.

BACKGROUND OF THE EMBODIMENTS

1. Field of the Invention

Embodiments of the invention relate to a high pressure device for fluid media.

In particular, embodiments are directed to a cylinder unit of a high pressure pump for a fluid with a pressure of greater than 2,000 bars. The cylinder unit includes a cylinder formed by shrink connection of at least two concentric, tubular components, and the cylinder unit is detachably connected on one side to a flange part with a sealing system, in which a plunger is axially moveable back and forth, and is connected on another side to a valve body.

2. Discussion of Background Information

Components of high pressure devices, in particular a wall of a cylinder of high pressure pumps, are exposed during operation to considerable tensile stresses, which are possibly of an unsteady nature or act in a pulsating manner, due to an internal pressure of over 2,000 bars.

The tensile stresses can thereby approach the yielding point of the materials in sections of the cylinder wall, but at least cause a long-duration flow of the material, which is constantly diminished in a logarithmic tempo at a given tension.

It is known to a person skilled in the art to provide tubular component parts with concentric, thermally shrunk-on parts for high internal pressures or to reinforce fluid-conducting pipes with shrunk-on outer components or outer pipes.

Via pipe body of this type formed by a shrinking method from multiple concentric components, it is possible to embody the tensions in the parts of the pipe wall for a high pressure operation such that the most uniform material stresses possible occur over the cross section or that the tensile stress concentrations in the part, which could cause a plastic deformation of the material, are avoided.

Cylinder units or pipe bodies made from a compound of at least two components formed by a shrinking-on of an outer part have however among other things a disadvantage, namely that the inner component in the pipe compound can be axially moved and/or stretched under pulsating or possibly alternating stress. This can, in the flange region of the plunger device and/or in the valve body connection region, lead to problems in the system of a sealing of the high pressure fluid.

SUMMARY OF THE EMBODIMENTS

In embodiments, the invention provides a remedy to the deficiencies in the prior art and creates a class-conforming cylinder unit for a high pressure pump of the type named at the outset. According to embodiments, during heavy continuous operation of the high pressure pump, a tightness of the connection of the cylinder unit to a flange part in the plunger region and to a flange part in the region of the valve body is ensured.

According to the embodiments of the invention, a cylinder unit includes a cylinder formed by a shrink connection of at least two concentric, tubular components with grooves on the connection surface. The cylinder is detachably connected on one side to a flange part with a sealing system, in which a plunger is axially moveable back and forth, and on another side to a valve body. A bearing bushing of the sealing system and a radially outermost component of the cylinder bear against the flange part and form intermediately a gap, in which a tensioned, disk-shaped spring device is supported distally on an outer component of the cylinder and proximally on an outside of the bearing bushing to face the flange part. Axially opposite the flange part, the tubular components of the cylinder in the region of a surface bearing against the valve body have a metallic connection, in particular a welded connection.

In an advantageous embodiment of the invention, the grooves on the connection surface of the tubular components are essentially semicircularly embodied or formed in cross section with a depth of up to 2 mm.

Embodiments of the invention are directed to a cylinder unit of a high pressure pump for a fluid. The cylinder unit includes a cylinder formed by at least two concentric tubular components coupled by a shrink connection. A flange part with a sealing system is detachably connected on one side of the cylinder, and the sealing system has a plunger movable back and forth and a bearing bushing. A valve body is connected on an other side of the cylinder. The bearing bushing and a radially outermost component of the cylinder are arranged to bear against the flange part to form an intermediate gap, a spring device has a distal portion supported on the outermost component of the cylinder and a proximal portion on an outside of the bearing bushing facing the flange part, and a valve body against which an other side of the cylinder bears are included. The tubular components have a metallic connection in a region of a surface bearing between the valve body and the cylinder.

According to embodiments, the high pressure pump can be structured and arranged for water with a maximum pressure of greater than 2,000 bars.

In accordance with other embodiments of the invention, the metallic connection between the tubular components may be a welded connection.

In embodiments, at least one connection surface between the two concentric tubular components can have grooves. The grooves on the at least one connection surface can be formed with a depth of up to 2 mm. The grooves can generally be semicircularly formed on the at least one connection surface.

According to still other embodiments of the instant invention, a recess can be formed in an end of the one side of the cylinder. At least part of the recess may be formed in the outermost component.

In still further embodiments of the invention, the spring device can be structured and arranged to allow limited axial movement of an inner component. The spring device may limit the axial movement of the inner component to less than 1 mm. Further, the spring device can limit the axial movement of the inner component to up to 0.95 mm.

In accordance with still yet other embodiments of the present invention, the spring device can include a tensioned, disk-shaped spring.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 shows a cylinder unit in a high pressure pump.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In principle, a cylinder unit Z of a high pressure pump is illustrated in FIG. 1. As shown in the FIGURE, one axial side of cylinder unit Z is detachably connected to a sealing system 3 for a plunger piston P and the other axial side of cylinder unit Z is connected, and preferably detachably connected, to a valve body 6. Sealing systems for plunger pistons are described in European Patent Nos. EP 0 505 352 B1 and EP 1 845 290 B1, the disclosures of which are expressly incorporated by reference herein in their entireties.

A cylinder unit 1 according to the invention is formed by an inner component 12 with at least one outer component 11 shrunk thereon. Further, grooves 15 are formed on at least one of the connection surfaces of the tubular components 12, 11 by recesses.

Sealing system 3 for plunger piston P has, in a manner known per se, a bearing bushing 31 supported in an axial direction by a flange part 2. An outer region of an outermost component 11 of cylinder 1 is supported on flange part 2 and a recess is formed in the flange part 2 supported end of cylinder 1 in a radial direction up to bearing bushing 31.

A spring device 5, such as a disk spring, is located in the recess, as shown in FIG. 1. A distal portion of spring device 5 is supported on outermost component 11 of the cylinder 1 and a proximal part of spring device 5 is arranged to apply pressure, via its prestress, on an outside of bearing bushing 31. Further, bearing bushing 31 is axially retained by flange part 2.

Between spring device 5 and inner component 12 of cylinder 1, a gap 4 is embodied or formed, which allows for axial movement of inner component 12 up to 0.95 mm and thus, at least ensures a tightness of the connection.

On an end of cylinder 1 axially opposite sealing system 3 of plunger P, i.e., in a region of a valve body 6 of cylinder 1, components 11, 12 are metallically connected or welded to one another and bear against an opposite surface on valve body 6 in a sealing manner with their worked faces 14.

For the hindrance or prevention of a movement of components 11, 12 of cylinder 1 for a high pressure pump, it can be advantageous if grooves 15 in the region of the connection surface are essentially semicircularly embodied or formed in cross section with a depth of up to 2 mm and possibly run spirally in an axial direction.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A cylinder unit of a high pressure pump for a fluid comprising:

a cylinder formed by at least two concentric tubular components coupled by a shrink connection;

at least one connection surface between the at least two concentric tubular components has grooves;

a flange part with a sealing system being detachably connected on one side of the cylinder, the sealing system having a plunger movable back and forth and a bearing bushing;

the bearing bushing being pressed against the flange part by a disk spring coupled to a radially outermost component of the at least two concentric tubular components;

the disk spring having a distal portion supported on the radially outermost component and a proximal portion supported on a part of the bearing bushing; and a valve body connected to bear against an other side of the cylinder, wherein the at least two concentric tubular components have a welded metallic connection to each other in a region of the valve body.

2. The cylinder unit according to claim 1, wherein the high pressure pump is structured and arranged for water with a maximum pressure of greater than 2,000 bars.

3. The cylinder unit according to claim 1, wherein the grooves on the at least one connection surface are formed with a depth of up to 2 mm.

4. The cylinder unit according to claim 3, wherein the grooves are generally semicircularly formed on the at least one connection surface.

5. The cylinder unit according to claim 1, wherein a recess is formed in an end of the one side of the cylinder.

6. The cylinder unit according to claim 5, wherein at least part of the recess is formed in the outermost component.

7. The cylinder unit according to claim 1, wherein the disk spring is structured and arranged to allow limited axial movement of an inner component of the at least two concentric tubular components.

8. The cylinder unit according to claim 7, wherein the disk spring limits the axial movement of the inner component to less than 1 mm.

9. The cylinder unit according to claim 7, wherein the disk spring limits the axial movement of the inner component to up to 0.95 mm.

10. The cylinder unit according to claim 5, wherein the disk spring is arranged within the recess.

11. The cylinder unit according to claim 10, wherein a gap is formed between the disk spring and a bottom of the recess.

12. The cylinder unit according to claim 11, wherein the gap is dimensioned to allow a stretching of at least a radially innermost component of the two concentric tubular components.

13. The cylinder unit according to claim 1, wherein a gap is formed between the disk spring and at least a part of an axial end of the one end of the cylinder.

14. The cylinder unit according to claim 13, wherein the gap is dimensioned to allow a stretching of at least a radially innermost component of the two concentric tubular components.

15. The cylinder unit according to claim 6, wherein the distal portion of the disk spring bears against a part of the outermost component within the recess.

16. The cylinder unit according to claim 15, wherein the bearing bushing comprises a shoulder located outside of a radially innermost component of the two concentric tubular components of the cylinder, and the proximal portion of the disk spring bears against a surface of the shoulder opposite the flange part.

17. The cylinder unit according to claim 16, wherein a gap is formed between the disk spring and a bottom of the recess.

18. The cylinder unit according to claim 17, wherein the gap is dimensioned to allow a stretching of at least a radially innermost component of the two concentric tubular components.

19. The cylinder unit according to claim 1, wherein the welded metallic connection is located in a sealing face bearing against the valve body.

* * * * *